US009888717B2

(12) United States Patent
Liu

(10) Patent No.: US 9,888,717 B2
(45) Date of Patent: Feb. 13, 2018

(54) ELECTRONIC CIGARETTE CASE WITH CIGARETTE LIGHTER

(71) Applicant: KIMREE HI-TECH INC., Tortola (VG)

(72) Inventor: Qiuming Liu, Huizhou (CN)

(73) Assignee: SHENZHEN KIMSEN TECHNOLOGY CO., LTD., Shenzhen, Guangdong Province (CN)

( * ) Notice: Subject to any disclaimer, the term of this patent is extended or adjusted under 35 U.S.C. 154(b) by 223 days.

(21) Appl. No.: 14/412,440

(22) PCT Filed: Apr. 15, 2013

(86) PCT No.: PCT/CN2013/074217
§ 371 (c)(1),
(2) Date: Dec. 16, 2015

(87) PCT Pub. No.: WO2014/169423
PCT Pub. Date: Oct. 23, 2014

(65) Prior Publication Data

US 2016/0095353 A1 Apr. 7, 2016

(51) Int. Cl.

| | |
|---|---|
| ***B65D 43/16*** | (2006.01) |
| ***A24F 47/00*** | (2006.01) |
| ***A24F 15/10*** | (2006.01) |
| ***A24F 15/18*** | (2006.01) |
| ***B65D 25/10*** | (2006.01) |
| ***B65D 85/00*** | (2006.01) |

(52) U.S. Cl.
CPC ..... *A24F 47/008* (2013.01); *A24F 15/10* (2013.01); *A24F 15/18* (2013.01); *B65D 25/10* (2013.01); *B65D 85/70* (2013.01)

(58) Field of Classification Search
CPC ..... A24F 15/12; A24F 47/008; B65D 43/16
USPC ..... 206/86, 85, 266, 268
See application file for complete search history.

(56) References Cited

U.S. PATENT DOCUMENTS

2004/0020500 A1* 2/2004 Wrenn ..... A24C 5/478 131/194

FOREIGN PATENT DOCUMENTS

| | | | |
|---|---|---|---|
| CN | 101088427 | A | 12/2007 |
| CN | 201014501 | Y | 1/2008 |
| CN | 201726861 | U | 2/2011 |
| CN | 201797992 | U | 4/2011 |
| WO | 01/54521 | A1 | 8/2001 |

* cited by examiner

*Primary Examiner* — King M Chu
(74) *Attorney, Agent, or Firm* — Cheng-Ju Chiang

(57) ABSTRACT

An electronic cigarette case with a cigarette lighter comprises: a case body, a case cover buckled with the case body, the cigarette lighter located in the case body, a battery located in the case body and used for supplying power to the cigarette lighter, and a charger located in the case body and used for charging the battery. Because the cigarette lighter is built in the electronic cigarette case, the problem of inconvenience in smoking is avoided that a smoker leaves a lighter when the smoker has a conventional cigarette, and personalized requirements of the smoker are met to some extent.

9 Claims, 5 Drawing Sheets

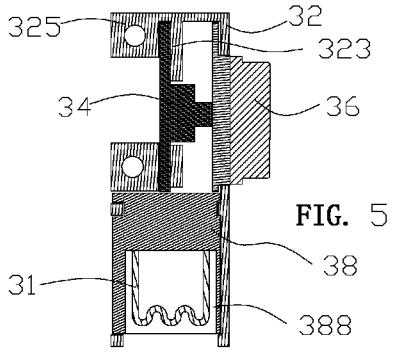
FIG. 5
FIG. 5
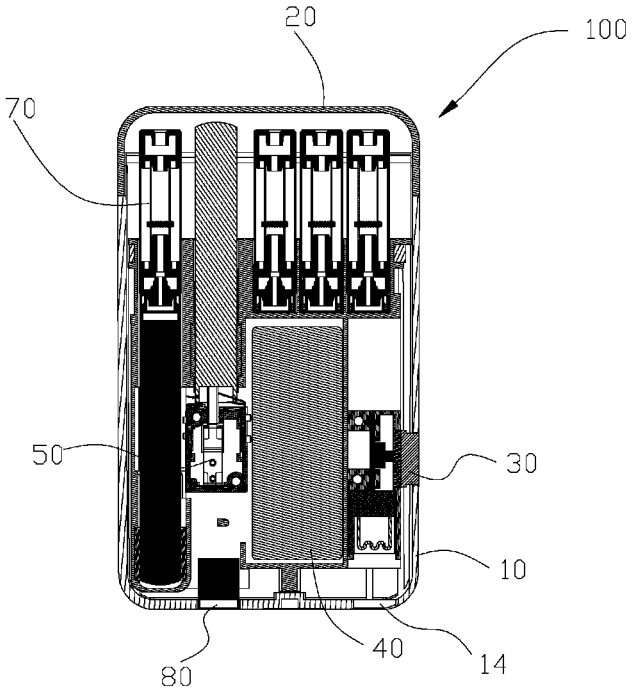
FIG. 6

ELECTRONIC CIGARETTE CASE WITH CIGARETTE LIGHTER

CROSS REFERENCE TO RELATED APPLICATIONS

The present application is a 35 U.S.C. § 371 National Phase conversion of International (PCT) Patent Application No. PCT/CN2013/074217, filed on Apr. 15, 2013, the disclosure of which is incorporated by reference herein. The PCT International Patent Application was filed and published in Chinese.

TECHNICAL FIELD

This invention relates to a field of electronic cigarette case, and particularly to an electronic cigarette case which has a cigarette lighter.

DESCRIPTION OF BACKGROUND

A current electronic cigarette case is often used to store electronic cigarettes for the smoker using. Besides electronic cigarettes, smoker usually smokes traditional cigarettes, so that various tastes are obtained for desire.

For smoking traditional cigarettes, smoker often needs take cigarette lighter by himself. However, because the cigarette lighter is small, smoker usually forgets where it is placed thus it is inconvenient for smoking traditional cigarette.

Therefore, the cigarette lighter can be integrated in the electronic cigarette case, which can solve the problem in the art that smoker often forgets the cigarette lighter which causes inconvenience for smoking traditional cigarette. Additionally, the cigarette lighter can be integrated in the electronic cigarette case which meets the personalized desires to a great degree.

SUMMARY

An object of the present invention is to provide an electronic cigarette case with a cigarette lighter, which can solves the problem of the smoker for inconvenience of lightening the cigarette, and meets the personalized desires.

To achieve the above object, the following technical protocols provided in the present invention:

an electronic cigarette case with a cigarette lighter comprises a case body, a case cover buckled with the case body, a cigarette lighter located in the case body, a battery located in the case body and used for supplying power to the cigarette lighter, and a charger located in the case body and used for charging the battery.

The cigarette lighter comprises a frame, a circuit board fixed in the frame, a button mounted in the frame to trigger the circuit board, a heating-wire seat mounted in the frame and a heating wire provided in the heating-wire seat and under a control of the circuit board.

A bottom of the case body defines a cigarette entrance for inserting a cigarette close to the heating wire.

The frame comprises a top wall, a rear wall, a side wall and a bottom wall connected in turn; the rear wall is provided with both positioning plates in a vertical arrangement and both positioning blocks in a vertical arrangement; a vertical space is defined between the positioning plates and the corresponding positioning blocks; a support plate is horizontally formed from the rear wall; the circuit board is disposed in the vertical space, and is fixed in the frame by the support plate.

The side wall defines a through hole; the button comprises a pressing part and a flange formed from a side of the pressing part; the pressing part passes the through hole from an inner side of the side wall and extends outside of the side wall, and the flange is stopped against the inner side of the side wall.

The circuit board is set with a switch which is triggered by the flange; a horizontal space is defined between the support plate and one positioning block in both positioning blocks of which is much closer to the support plate; the heating-wire seat comprises a main body and a hanging plate on a top of the main body, an annular slot is formed between the hanging plate and the main body; the hanging plate is set in the horizontal space, and the support plate is set in the annular slot.

A bottom of the main body of the heating-wire seat forms an opening; the heating wire is accommodated in the opening.

A rubber pat is set in the inner side of the side wall to resiliently contact with the flange of the button.

A fixation rack is further provided in the case body, a power shell of an electronic cigarette electrically connected with the charger and at least one atomizer of the electronic cigarettes is held in the fixation rack; a bottom of the case body forms a USB port.

A fixation rack is further provided in the case body, the fixation rack defines a cigarette entrance; and the opening of the heating-wire seat faces the cigarette entrance in the fixation rack.

Comparing to prior arts, the present invention has advantages as:

Because the cigarette lighter is built in the electronic cigarette case, the problem of inconvenience in smoking is completely avoided that a smoker forgets a lighter when the smoker has a conventional cigarette, and personalized requirements of the smoker are met to some extent due to this new electronic cigarette case.

DESCRIPTION OF THE DRAWINGS

FIG. 5 is a cross-sectional view of the cigarette lighter in FIGS. 3-4.

FIG. 6 is a cross-sectional view of the electronic cigarette case with a cigarette lighter in accordance with the first embodiment of the present invention.

DETAILED DESCRIPTION OF THE EMBODIMENTS

Figure 1:
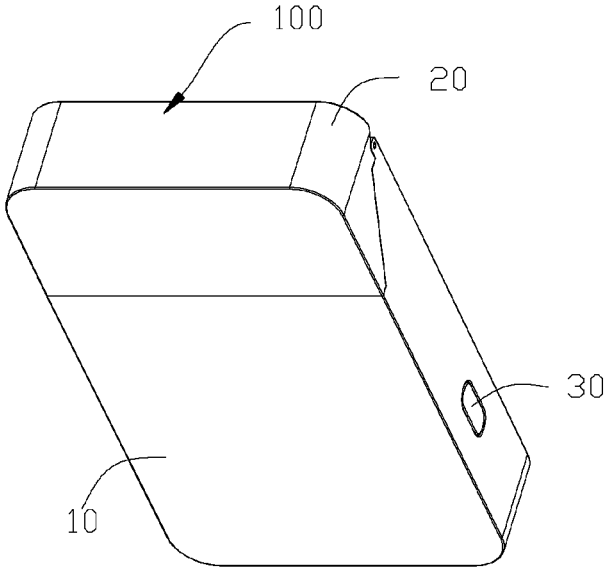
FIG. 1 is a perspective view of an electronic cigarette case with a cigarette lighter in accordance with a first embodiment of the present invention.
Figure 2:
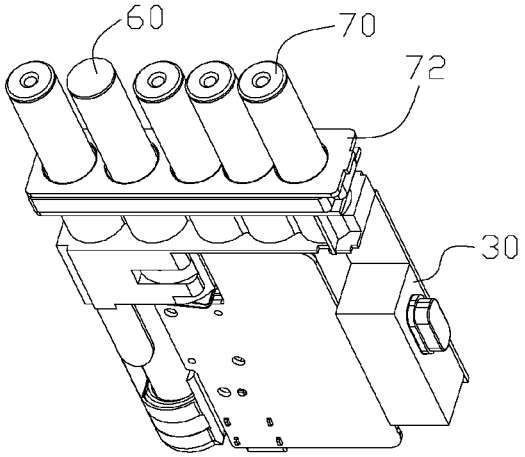
FIG. 2 is a perspective view of an inner structure of the electronic cigarette case with a cigarette lighter in FIG. 1.
Figure 3:
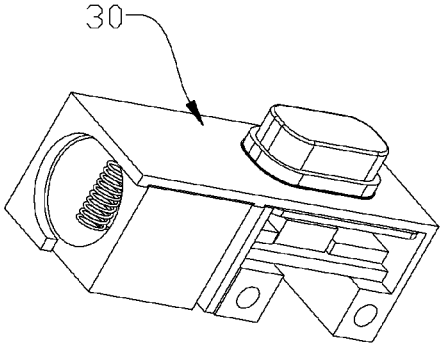
FIG. 3 is a perspective view of a cigarette lighter of the electronic cigarette case with a cigarette lighter in FIGS. 1-2.
Figure 4:
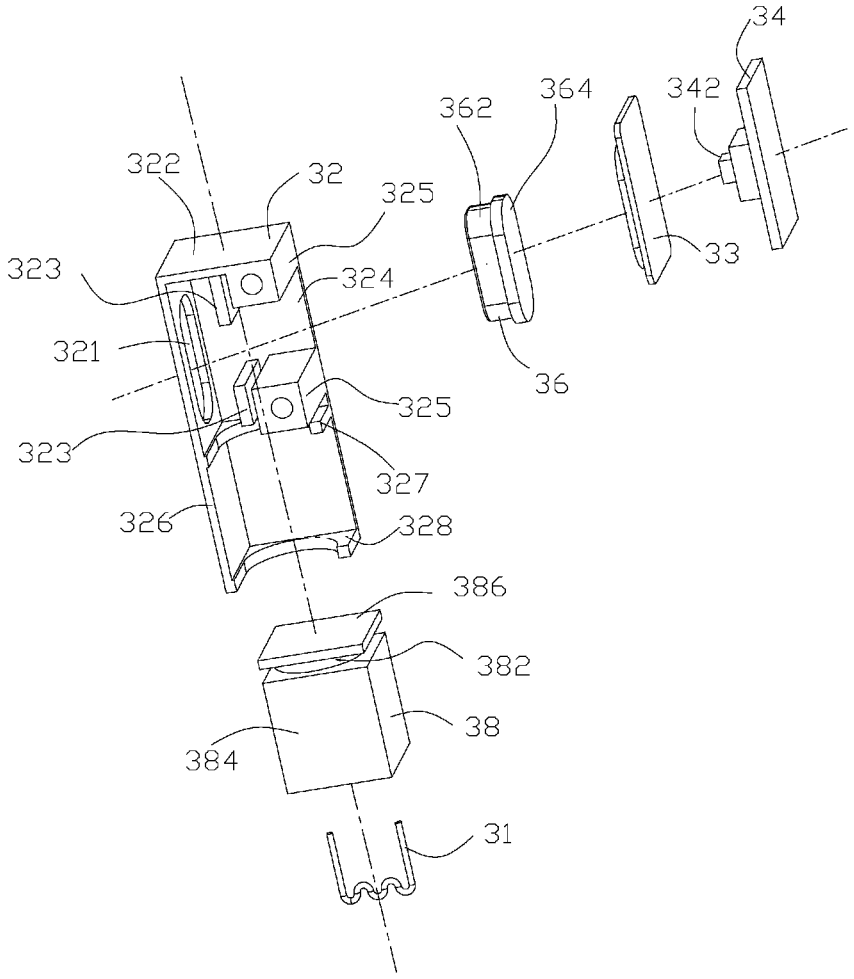
FIG. 4 is an exploded view of the cigarette lighter in FIG. 3.
Figure 7:
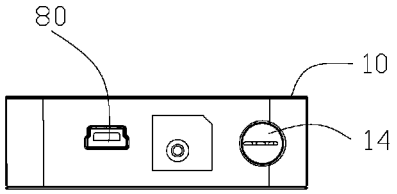
FIG. 7 is a top view of the electronic cigarette case with a cigarette lighter in FIG. 1.

An electronic cigarette case with a cigarette lighter provided in the present invention, which is incorporated with a lighter-function in an electronic cigarette case. In detail, a cigarette lighter is built in the electronic cigarette case, which resolve the smoking inconvenience for the smoker who easily forgets taking a lighter, in other words, the smoker may light the traditional cigarette using the cigarette lighter built-in the electronic cigarette case. Moreover, the electronic cigarette case integrated with a lighter-function meets the personalized requirement of the smoker.

The present invention is further described in detail in accordance with the embodiment and the drawings:

Referring to FIGS. 1 to 7, an electronic cigarette with a cigarette lighter 100 is provided according to a first embodiment of the present invention, comprising a case body 10, a case cover 20 flipped on the case body 10, a cigarette lighter 30 located in the case body 10, a battery 40 located in the case body 10 for supplying power to the cigarette lighter 30, and a charger 50 within the case body 10 for charging the battery 40.

The cigarette lighter 30 comprises a frame 32, a circuit board 34 mounted in the frame 32, a button 36 mounted in the frame 32 for triggering the circuit board 34, a heating-wire seat 38, and a heating wire 31 equipped in the heating-wire seat 38 and under the control of the circuit board 34.

A cigarette entrance 14 is set in a bottom of the case body 10 to allow cigarettes inserted therein for approaching the heating wire 31.

When pushing the button 36, the button 36 is pressed downwards to trigger the circuit board 34, the circuit board 34 controls the heating wire 31 and the batter 40, thus electric current goes through the heating wire 31, then the heating wire 31 heats up; thereafter, smoker inserts traditional cigarette into the case body 10 from the cigarette entrance 14 in the bottom of the case body 10, and takes it close to the heat wire 31 being heated, thereby the cigarette is lighted.

In such way that the cigarette lighter 30 is built in the case body 10, smoker can light traditional cigarette using the built-in cigarette lighter. Moreover, lighter-function is integrated in the electronic cigarette case which meets personalized requirements of smoker.

Preferably, the frame 32 comprises a top wall 322, rear wall 324, side wall 326 and bottom wall 328 connected in turn. The rear wall 324 is equipped with both positioning plates 323 in a vertical arrangement and both positioning blocks 325 in a vertical arrangement. A space (not labeled) is longitudinally defined between the positioning plates 323 and the positioning blocks 325. Moreover, a support plate 327 is formed from a middle portion of the rear wall 324. The circuit board 34 is disposed in the longitudinal space and is fixed in the frame 32 by the support plate 327.

Preferably, the side wall 326 defines a through hole 321; the button 36 comprises a pressing part 362 and a flange 364 formed at one side of the pressing part 362; the pressing part 362 extends out of the side wall 326 through the through hole 321 and from an inner side of the side wall 326, and the flange 364 is stopped against the inner side of the side wall 326. Via such structure, the button 36 can move transversely but not leave away from the side wall 326.

Preferably, the circuit board 34 is set with a switch 342 which can be triggered by the flange 364. When the flange 364 pushes the switch 342 in a certain degree, the switch 342 will be triggered to start the heat wire 31.

Preferably, a horizontal space (not labeled) is defined between the support plate 327 and one positioning block 325 of both positioning block 325 which is relatively closer to the support plate 327; the heating-wire seat 38 comprises main body 384 and a hanging plate 386 formed on top of the main body 384, an annular slot 382 is formed between the hanging plate 386 and the main body 384; the hanging plate 386 is disposed in the horizontal space, and the support plate 327 is held in inner of the annular slot 382; thereby the heating-wire seat 38 is fixed in the frame 32.

Preferably, the heating-wire seat 38 forms an opening 388 in the bottom of the main body 384, and the heating wire 31 is accommodated in the opening 388.

Further preferably, a rubber pad 33 is provided in the inner side of the side wall 326 of the frame 32 to elastically contact with the flange 364 of the button 36, in such way to offer resilience to the button 36, thereby while the button 36 is pressed, the button 36 can quick return.

Preferably, the case body 10 is further equipped with a fixation rack 72 therein, a power shell 60 of the electronic cigarette electrically connected with the charger 50 and atomizers 70 of the electronic cigarettes is held in the fixation rack 72.

Preferably, a USB port 80 is defined in the bottom of the case body 10, through which a power supply to the charger 50 is available from electronic equipments such as a computer.

In accordance with the embodiment, the traditional cigarette is inserted into the case body 10 from the cigarette entrance 14 in the bottom of the case body 10, and keeps close to the heating wire 31 in the opening 388 of the cigarette lighter 30, thus the cigarette will be lighted by the heating wire 31 being heated and raising temperature. In other words, the opening 388 faces the bottom of the case body 10. However, in accordance with other embodiments, the present invention may use various structures on the top of the case body 10 to light the cigarette, for instance, such structure is disclosed in accordance with the second embodiment of the present invention.

Figure 8:
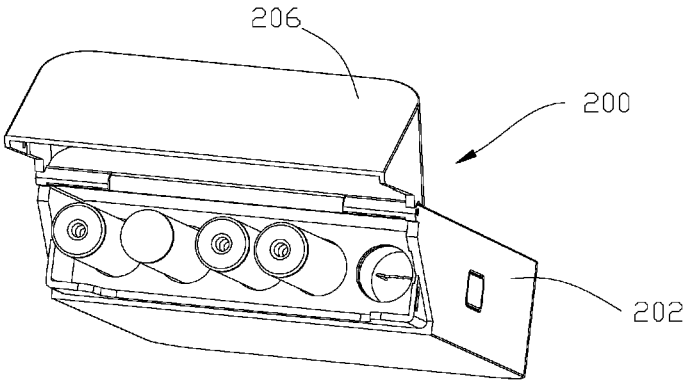
FIG. 8 is a perspective view of the electronic cigarette case with a cigarette lighter in accordance with a second embodiment of the present invention.
Figure 9:
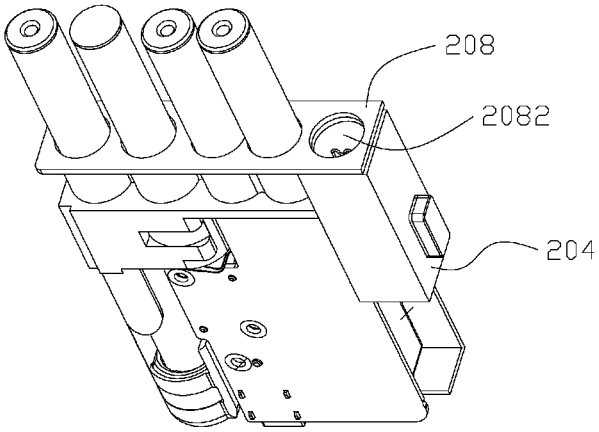
FIG. 9 is a perspective view of an inner structure of the electronic cigarette case with a cigarette lighter in FIG. 8.
Figure 10:
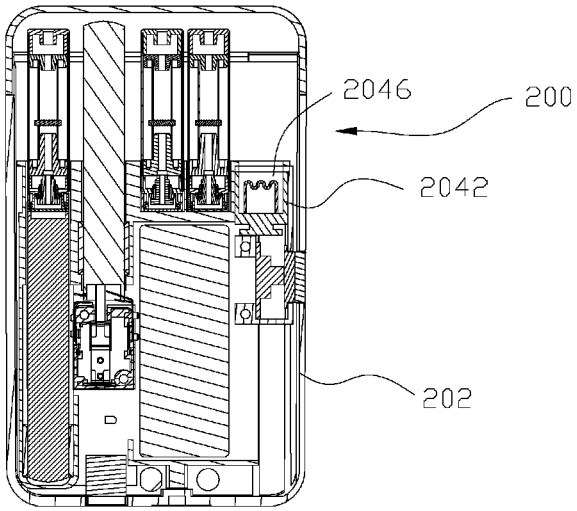
FIG. 10 is a cross-sectional view of the electronic cigarette case with a cigarette lighter in accordance with the second embodiment of the present invention.

As shown in FIGS. 8-10, in accordance with the second embodiment of the present invention, an electronic cigarette case with a cigarette lighter therein 200 has similar structure as the electronic cigarette case with a cigarette lighter therein 100 in the first embodiment. Which is different: in this embodiment, the cigarette entrance is not set in the bottom of a main body 202 of a cigarette lighter 204, but is defined in a fixation rack 208, namely cigarette entrance 2082; an opening 2046 of a heating-wire seat 2042 faces the cigarette entrance 2082 in the fixation rack 208. When needs to light cigarette, the smoker opens the case cover 206, starts the cigarette lighter 204, and inserts cigarette into the opening 2046 from the cigarette entrance 2082, thereby lights the cigarette.

The above-mentioned is only the embodiments of the present invention, but not be limited thereto. It should be noted, for the persons of ordinary skill in this field, modifications, decorations, replacements, corporations, or simplifications within the spirit of the present invention can be made, which should be seemed to be included in the claimed scope of this invention.

What is claimed is:

1. An electronic cigarette case, comprising a case body, a case cover buckled to the case body, a cigarette lighter located in the case body, a battery located in the case body and used for supplying power to the cigarette lighter, and a charger located in the case body and used for charging the battery; wherein the cigarette lighter comprises a frame, a circuit board fixed in the frame, a button mounted in the frame to trigger the circuit board, a heating-wire seat mounted in the frame and a heating wire provided in the heating-wire seat and under a control of the circuit board.

2. The electronic cigarette case as described in claim 1, wherein a bottom of the case body defines a cigarette entrance for inserting a cigarette close to the heating wire.

3. The electronic cigarette case as described in claim 1, wherein the frame comprises a top wall, a rear wall, a side wall and a bottom wall connected in turn; the rear wall is provided with both positioning plates in a vertical arrangement and both positioning blocks in a vertical arrangement; a vertical space is defined between the positioning plates and the corresponding positioning blocks; a support plate is horizontally formed from the rear wall; the circuit board is disposed in the vertical space, and is fixed in the frame by the support plate.

4. The electronic cigarette case as described in claim 3, wherein the side wall defines a through hole; the button comprises a pressing part and a flange formed from a side of the pressing part; the pressing part passes the through hole from an inner side of the side wall and extends outside of the side wall, and the flange is stopped against the inner side of the side wall.

5. The electronic cigarette case as described in claim 4, wherein the circuit board is set with a switch which is triggered by the flange; a horizontal space is defined between the support plate and one positioning block in both positioning blocks of which is much closer to the support plate; the heating-wire seat comprises a main body and a hanging plate on a top of the main body, an annular slot is formed between the hanging plate and the main body; the hanging plate is set in the horizontal space, and the support plate is set in the annular slot.

6. The electronic cigarette case as described in claim 5, wherein a bottom of the main body of the heating-wire seat forms an opening, the heating wire is accommodated in the opening.

7. The electronic cigarette case as described in claim 6, wherein a rubber pat is set in the inner side of the side wall to resiliently contact with the flange of the button.

8. The electronic cigarette case as described in claim 1, wherein a fixation rack is further provided in the case body, a power shell of an electronic cigarette electrically connected with the charger and at least one atomizer of the electronic cigarettes is held in the fixation rack; a bottom of the case body forms a universal serial bus (USB) port.

9. The electronic cigarette case as described in claim 6, wherein a fixation rack is further provided in the case body, the fixation rack defines a cigarette entrance; and the opening of the heating-wire seat faces the cigarette entrance in the fixation rack.

* * * * *